US005846168A

United States Patent [19]

Murray

[11] Patent Number: 5,846,168

[45] **Date of Patent: *Dec. 8, 1998**

[54] HAND APPLIANCE FOR QUADRIPLEGIC KINESTHERAPY

[76] Inventor: Jeffrey L. Murray, 15 Menvnketesuck Rd., West Brook, Conn. 06498

[ * ] Notice: The term of this patent shall not extend beyond the expiration date of Pat. No. 5,685,809.

[21] Appl. No.: 857,553

[22] Filed: May 16, 1997

Related U.S. Application Data

[63] Continuation-in-part of Ser. No. 539,455, Oct. 5, 1995, Pat. No. 5,685,809.

[51] Int. Cl.[6] ..... A63B 21/065

[52] U.S. Cl. ..... 482/105; 482/139; 2/161.1; 2/161.4; 2/158; 602/64

[58] Field of Search ..... 482/44, 105, 106, 482/139; 602/21, 22, 62, 64; 601/1, 40; 2/16, 158, 159, 160, 161.1, 161.2, 161.5, 161.6, 161.7, 162, 910, 917; 623/61, 62

[56] References Cited

U.S. PATENT DOCUMENTS

| | | |
|---|---|---|
| 315,512 | 4/1885 | Kearns . |
| 1,469,315 | 10/1923 | Hansard . |
| 2,448,697 | 9/1948 | Bakke . |
| 3,541,990 | 11/1970 | Du Mas . |
| 3,774,242 | 11/1973 | Owen . |
| 3,903,546 | 9/1975 | Rhee . |
| 3,945,045 | 3/1976 | Rhee . |
| 4,062,073 | 12/1977 | Rhee . |
| 4,400,829 | 8/1983 | Willis . |
| 4,484,740 | 11/1984 | Green . |
| 4,684,122 | 8/1987 | Desmond et al. . |
| 4,698,850 | 10/1987 | Patton, Sr. et al. . |
| 4,782,825 | 11/1988 | Lonardo . |
| 5,058,576 | 10/1991 | Grim et al. . |
| 5,072,459 | 12/1991 | Kogler . |
| 5,163,678 | 11/1992 | Rogers . |
| 5,224,220 | 7/1993 | Andriola . |
| 5,353,440 | 10/1994 | Meldeau . |
| 5,415,623 | 5/1995 | Cherubini . |

FOREIGN PATENT DOCUMENTS

| | | |
|---|---|---|
| 9504507 | 2/1995 | Germany . |

*Primary Examiner*—Jeanne M. Clark
*Attorney, Agent, or Firm*—Robert A. Seemann

[57] ABSTRACT

A hooked plate is pivotally attached to a generally straight plate which is strapped between the user's wrist and forearm with the pivot near the wrist. An elastic strip holds the fingers on a tongue on the outer circumference of the hooked plate. The appliance walls, openings, and the fastening arrangement for the strip to the hooked plate and for attaching the straight plate to the users arm are for enabling self mounting on the hand by the quadriplegic user.

13 Claims, 9 Drawing Sheets

HAND APPLIANCE FOR QUADRIPLEGIC KINESTHERAPY

This application is a continuation-in-part of application Ser. No. 08/539,455, filed Oct. 5, 1995, now U.S. Pat. No. 5,685,809.

BACKGROUND OF THE INVENTION

1. Field of the Invention

This invention pertains to orthopedic braces, more specifically to a brace for a hand and wrist by which a quadriplegic person can use various kinds of exercise equipment, often without the aid of another person.

2. Description of the Prior Art

The art is replete with patented designs for wrist and hand supports.

U.S. Pat. No. 1,469,315, patented Oct. 2, 1923 by H. H. Hansard provides a glove for games such as golf or bowling. He describes a pair of spring steel support strips, one along the back of the hand from the forearm to the knuckles, and the other along the front of the hand from the forearm to the palm. A layer of material is provided between the strips and the hand under each end of the strips. The distal ends of the strips are held to the hand by a strap reinforcement around the back and palm of a covering glove. The proximal ends of the strips are held to the forearm by a buckling strap or band that is incorporated in the glove. The support strips may be additionally attached to the glove, for example by one or more rivets located between the ends of each strip.

U.S. Pat. No. 3,945,045 patented by J. G. Rhee, Mar. 23, 1976 describes a glove for protecting a hand during the practice of karate. A resilient plastic layer such as rubber or plastic foam is formed into a slip-on on glove which covers the wrist, back of the hand to the ends of the fingers, and thumb. The glove is held on the hand by straps around the thumb and two of the middle fingers of the user, or may be held on by a retainer that is glued to the glove. The retainer may include a pocket which receives the middle fingers, a pocket for the thumb and a loop molded integrally with the tops of the side hand portions that extends across the palm of the hand.

In U.S. Pat. No. 4,062,073 patented Dec. 13, 1977, J. G. Rhee describes a foam motorcycle glove which covers from the elbow to the wrist by an encasement, and over the backs of the fingers by a foam strip which extends to the finger tips. It is held on the hand by encasing the arm and against the back of the fingers by loops through the foam strip through which the fingers are inserted to about mid finger.

It is difficult, frustrating and costly for a quadriplegic who has some small remaining capability to exercise, to use exercise equipment which requires use of hands to grasp and hold on to the equipment, and to do it without help of another person. Many types of exercise equipment have a single bar or a pair of bar grips, or can be modified to be accessed by gripping bars.

An incomplete C6 quadriplegic who has full strength out to the elbows and only a hint of or negligible strength from elbow to hand can benefit greatly physically and psychologically from exercise but must wait for help from another to strap on hooks or other equipment to access the exercise equipment.

This invention gives an incomplete quadriplegic an appliance that provides personal, safe, relatively independent control over his exercise environment.

SUMMARY OF THE INVENTION

It is one object of the invention to provide an apparatus for hand and wrist support for access to certain kinds of exercise equipment by a user who is a quadriplegic such as due to spinal injury.

It is another object that the apparatus provides a functional grasp for the user on weight lifting equipment and other equipment which requires hand grasp.

It is another object that the apparatus, once on the user's hand, can be independently hooked on and off of various exercise equipment without assistance from another person.

It is another object that the apparatus may be mounted on the user's hand and removed from the user's hand without assistance from another person.

It is another object that the apparatus may be used to lift relatively heavy weights such as weights exceeding 130 pounds without causing discomfort to the quadriplegic user.

It is another object that the apparatus provides strength with lateral wrist movement for efficient and safe coupling between the user and the exercise equipment.

It is another object that the apparatus provides lateral stability on a weight bar.

It is another object that the apparatus provides relatively large area for evaporation of perspiration.

Other objects and advantages will become apparent from reading the ensuing description.

One kinestherapy appliance of the invention includes an elongated, rigid, first plate, and a second elongated U-shaped rigid plate. The second plate has a first end and a second end, the first end being on a first leg of the U-shape, and the second end being on a second leg of the U-shape.

The first end of the second plate is connected to a first end of the first plate on the front of the appliance so that the apex of the U-shape is distal from the first plate, and the second end of the second plate is proximal from the apex, the second leg being forward of the first leg.

First fastening means close to the wrist, proximal of the hand attaches one end of the first plate to the arm near the front of the wrist area. Second fastening means spaced proximally from the first fastening means attaches the other end of the first plate to the forearm over the front of the forearm.

Pivot means connect the first end of the second plate to the first end of the first plate so that the apex of the U-shape is distal from the pivot means, and is pivotal about an axis comprising the pivot means.

A flexible strip has a first end connected to the appliance. Third fastening means temporarily fasten the second end of the strip to the second end of the second plate so that the second through fifth fingers of a hand in the appliance are held on the second plate by the strip against the backs of the fingers. A tongue connected to the appliance is soft and curved so that it rises alongside a finger when the second through fifth fingers are on the tongue.

The third fastening means is connected between the second end of the strip and the second end of the second plate so that unfastening of the third fastening means may be made by pulling generally the second end of the strip away from the second end of the second plate in a direction within the range of a first line that is generally planar with and away from the second end of the second plate, to a line generally normal to the first line and away from the appliance, so that the unfastening may be done by the teeth of a quadriplegic user by pulling in the said away directions from the appliance.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
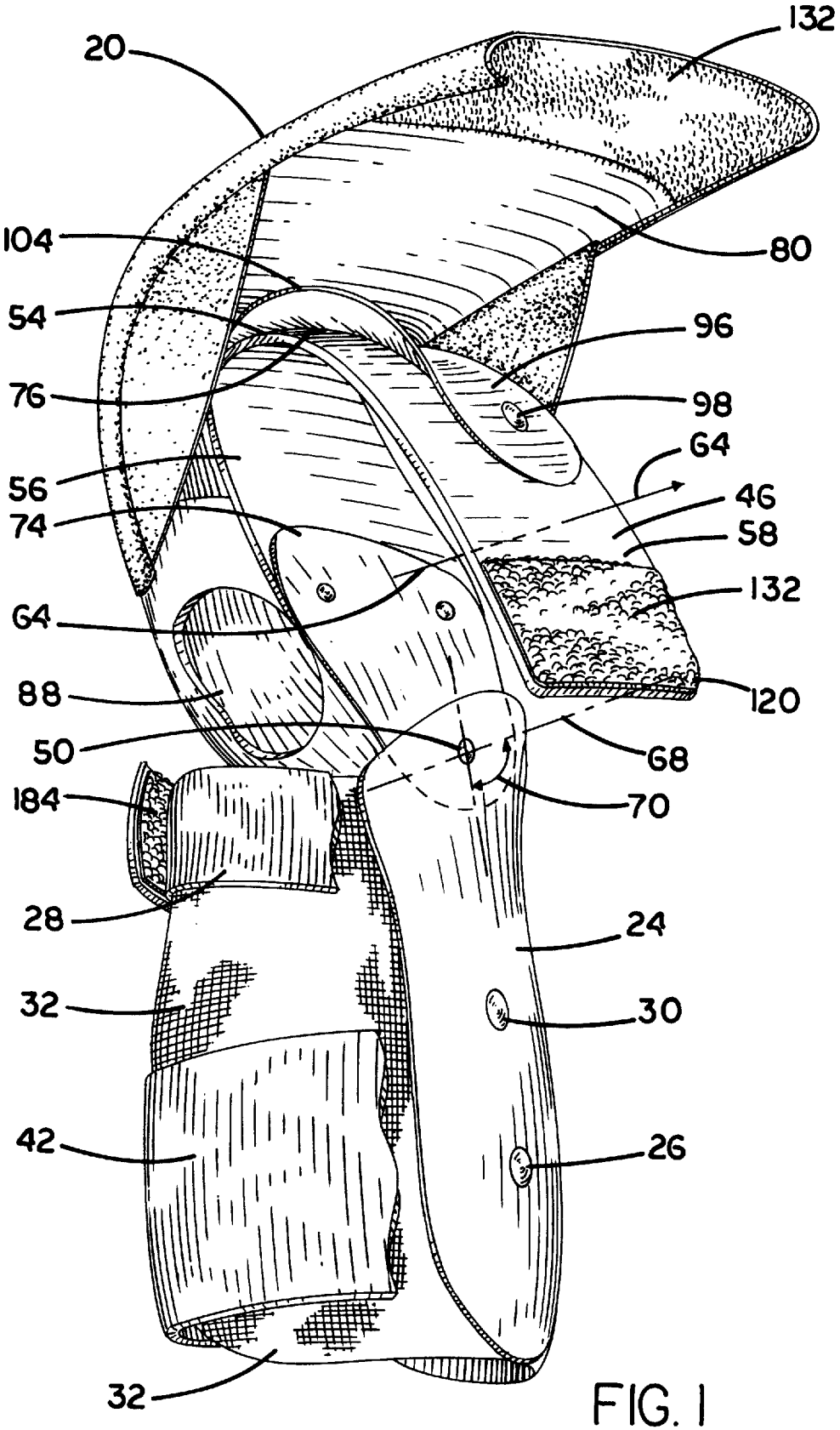
FIG. 1 is an oblique front and left side perspective view of an upstanding appliance of the invention.
Figure 2:
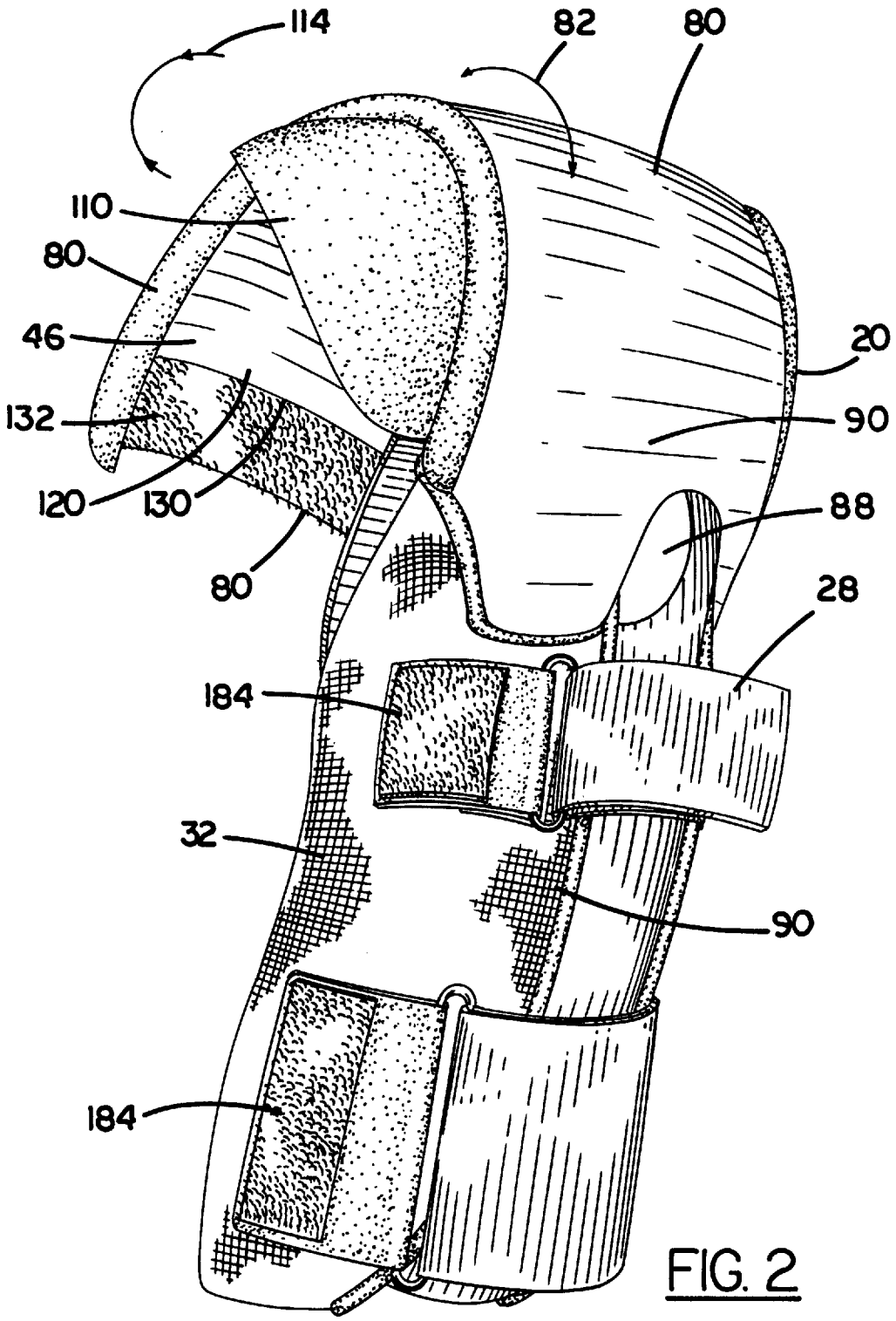
FIG. 2 is an oblique back and right side perspective view of the appliance of FIG. 1.
Figure 3:
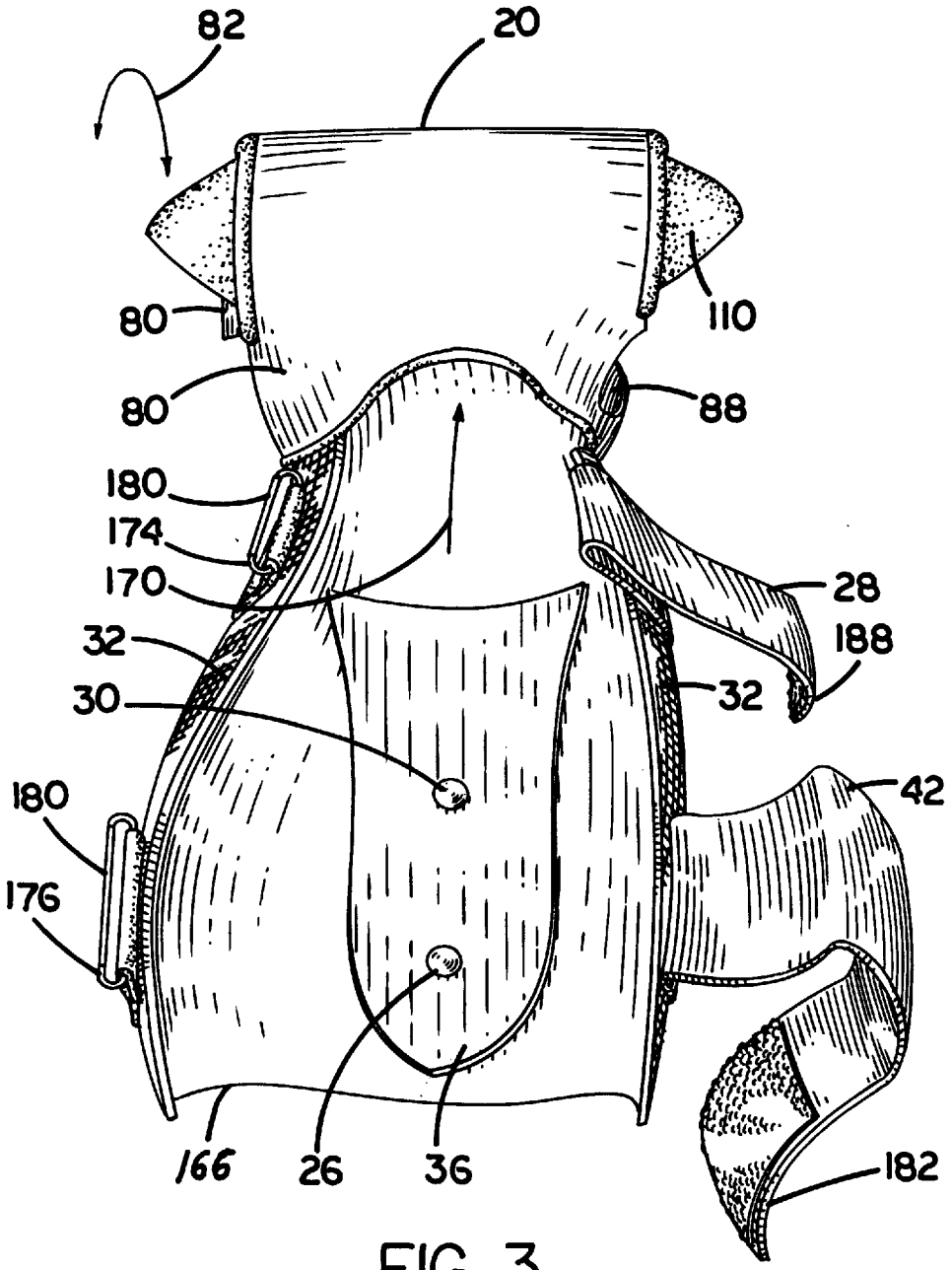
FIG. 3 is a back view of the appliance of FIG. 1, with the back of the appliance spread open.
Figure 4:
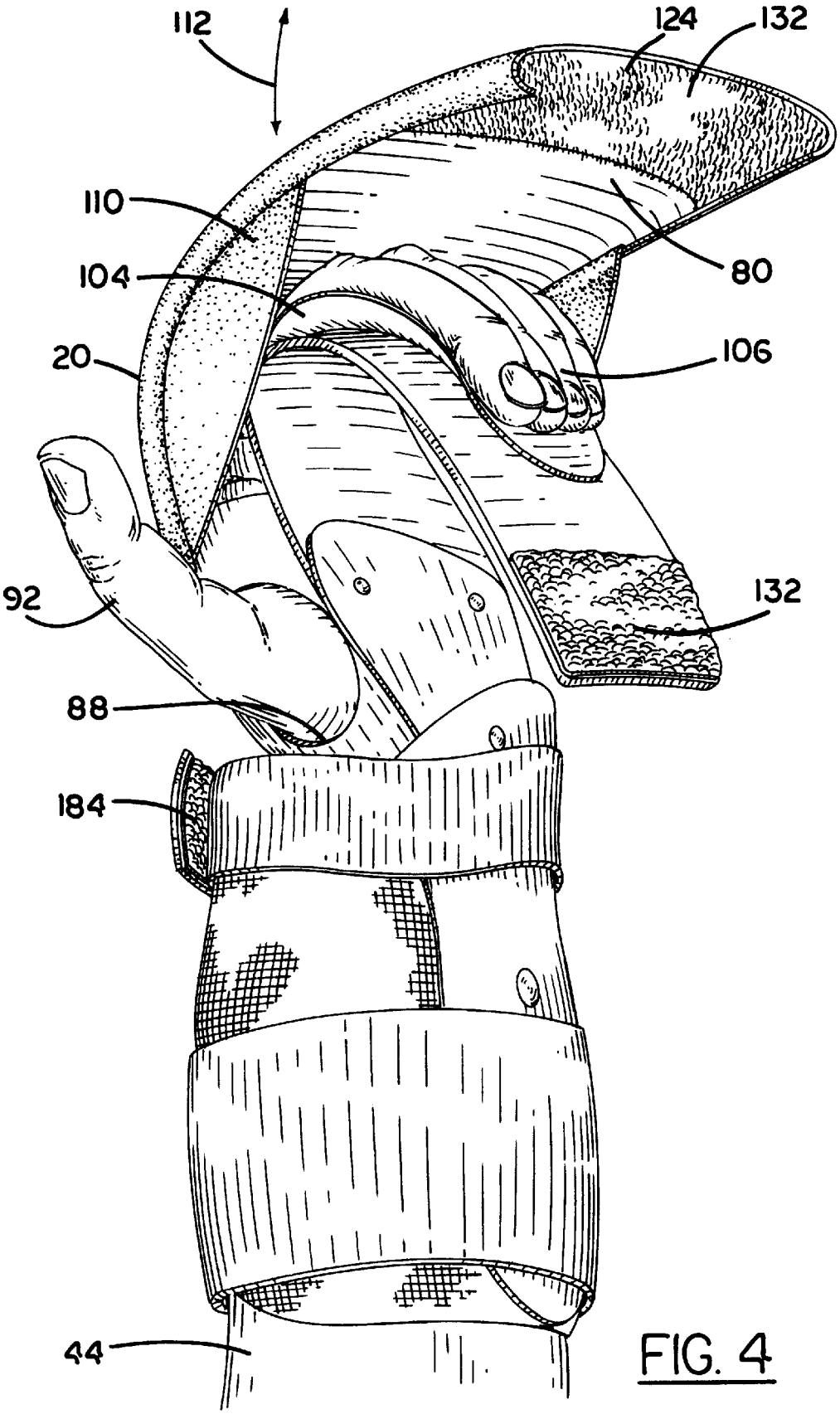
FIG. 4 is an oblique front and left side perspective view of the appliance of FIG. 1 mounted on a hand.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIGS. 1–5, kinestherapy appliance 20 is designed to mount on a hand and forearm of a user. The embodiment shown is adapted for a left hand.

Plate 24 is made from a rigid material such as Kydex (tm) plastic or aluminum, and is attached by rivet 26 to elastic strap 42, to wall 32 which is cloth reinforced foam, and retainer plate 36 which is a tough plastic or leather.

Rivet 30 attaches plate 24 to wall 32 and retainer plate 36.

Retainer plate 36 prevents pull-out of the rivets from stress and wear.

Elastic strap 28 is located by stitching, gluing or other attachment means on the appliance so that it is close to the wrist proximal of the hand, that is, it is in the region that includes being on the wrist or adjacent to the wrist on the end of the palm that is toward the elbow or body of the user.

Elastic strap 42 is located proximally of strap 28, or toward the elbow or body of the user. It is spaced from strap 28, and attaches plate 24 to the front 44 (anterior) of the forearm.

Straps 28 and 42 are shown cut away in FIG. 1 so that plate 24 and rivets 26 and 30 are more clearly seen.

Plate 46 is U-shaped and made of a rigid material such as Kydex or aluminum, and is connected to plate 24. In this arrangement, apex 54 of the U-shape of plate 46 is distal from plate 24.

Leg 58 of U-shaped plate 46 is forward 64 of leg 56.

Although plate 46 may be connected with plate 24 in a rigid manner such as formed as one piece with plate 46 or riveted or bonded to plate 24, it is preferably connected to plate 24 by pivot 50 which may be a rivet, screw and nut, or other pivot means.

Plate 46 is pivotal on pivot 50 about axis 68 which is generally normal 70 to plate 24, allowing for contouring and canting of plates 46 and 24 to provide an exercise angle for the hand.

Plate 74 connects plates 46 and 24, and includes pivot 50. It is preferably made of steel to add strength to the wrist area to resist bending the hand forward and back at the wrist while it permits, with the pivot, side to side tilting of the hand as plate 46 pivots about axis 68 approaching an anatomically correct movement of the wrist. This is important for maintaining parallel contact between inner curve 76 of the U-shape and a transverse exercise bar as the hand tilts during exercise.

Flexible strip 80 is connected to the back of appliance 20 and wraps over the outer circumference of the curve of U-shaped plate 46.

Opening 88 which is distal from strap 28, forward of the back 90 of appliance 20, and behind plate 46 permits lateral extension of the thumb 92 from the appliance.

Tongue 96 is fastened at one end to plate 46 by rivet 98. The other end of the tongue, not shown, may be fastened to the appliance by any suitable means. Tongue 96 is made of a soft, preferably breathable material such as leather which holds a preformed shape well. It is shaped with curves 104 to nestlingly receive the second through fifth fingers 106 of the hand.

Radial bridge wall 110 provides a barrier against lateral dislodging of the fingers from plate 46 when flexible strip 80 is separated from plate 46. As indicated by direction arrow 112, wall 110 is pulled straight relative to the curve of plate 46 by lifted strip 80 and passes close to the apex of plate 46 whereby it prevents lateral dislodging of the fingers from plate 46, such as when the fingers are being moved around the curve when the hand is being installed in appliance 20. Wall 110 bows or folds laterally 114 when strip 80 is brought down over and against plate 46. The bowing of wall 110 prevents it from interfering with an exercise bar 118 which may traverse inner curve 76. Wall 110 is removed in FIG. 5 for clarity of description.

Flexible strip 80 preferably extends beyond the ends of fingers 106 and is preferably made of a stretchable material so that when it is pulled down toward plate 46 and toward end 120 of leg 58, it holds fingers 106 in tongue 96 and resists vertically upward and lateral movement of the fingers.

Figure 6:
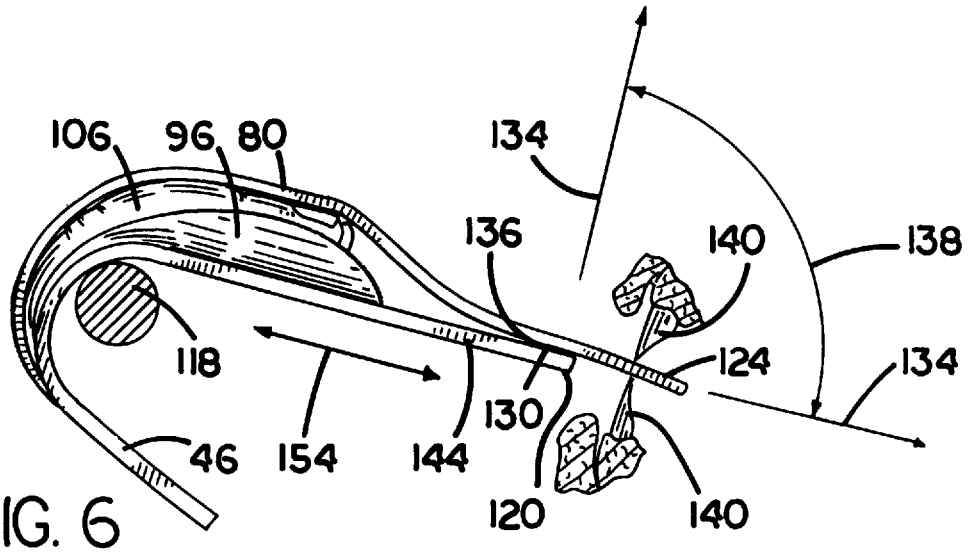
FIG. 6 is a partial side view of elements of another embodiment of the invention and teeth of a user.
Figure 7:
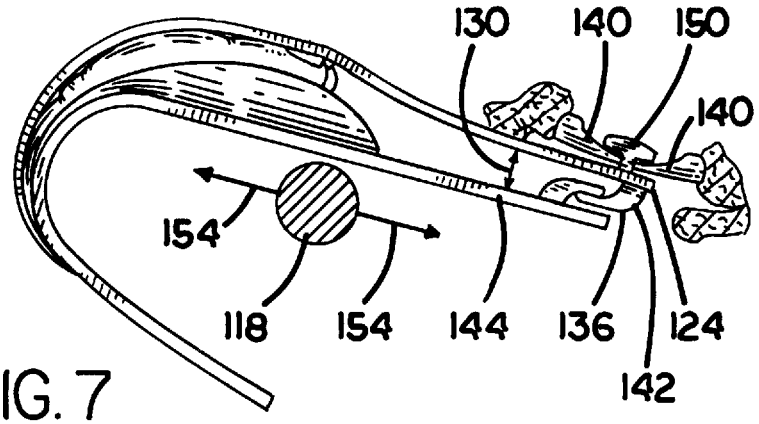
FIG. 7 is a partial side view of elements of another embodiment of the invention and teeth of a user.

Referring additionally to FIGS. 6 and 7, fastening end 124 of strip 80 with end 120 in face to face juxtaposition 130 is provided with fastening means 136 such as Velcro (tm) 132 or such as horizontal hooks 142 so that unfastening of the strip 80 from plate may be made by pulling on end 124, away from end 120 in a direction 134 that is within arc range 138, so that unfastening can be done by the teeth 140 of a quadriplegic user. Hooks 142 are enlarged in FIG. 7 for clarity.

Figure 5:
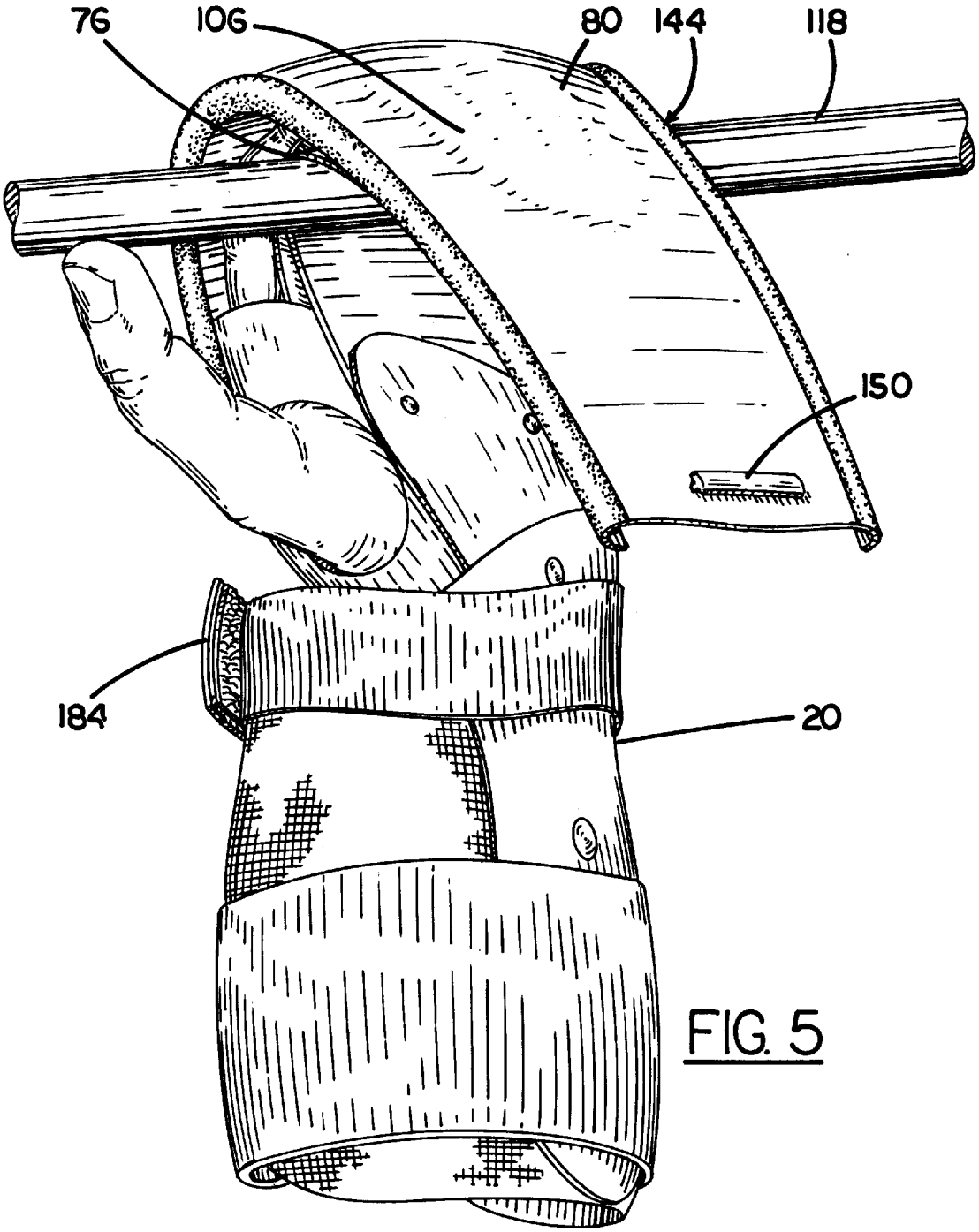
FIG. 5 is an oblique front and left side perspective view of the appliance of FIG. 1 mounted on a hand in operative position on an exercise bar.

In FIG. 6 the user bites on end 124 of strip 80. In FIGS. 5 and 7 the user bites on soft plastic grip protrusion 150.

In FIGS. 5, 6 and 7, backward facing inner wall 144 slidingly in direction 154 receives an exercise bar 118 without interference from fastening means 136. It is not necessary to have the appliance on a bar to install or remove it from a hand.

The U-shape plate may vary from a smooth curve so long as the shape guides the fingers and receives an exercise bar.

Figure 8:
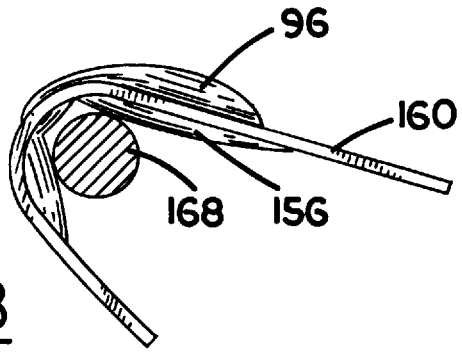
FIG. 8 is a partial side view of elements of another embodiment of the invention on an exercise bar.

For example in FIG. 8, inner wall 156 of U-shaped plate 160 has a contour which closely and slidingly fits over standard exercise bar 168.

The appliance can be installed on the hand by the user alone, without help from another person. The user places his or her hand in the appliance from the open back 166, see FIG. 3, and slides the palm and four fingers through opening 170 and thumb out through opening 88, so that the fingers are helped into place on tongue 96 by flexible strip 80 and radial bridge walls 110 which keep flexible strip 80 in proper shape for guiding the fingers.

The user then slips elastic straps 28 and 42 through bar pulleys 174 and 176 which may include roller bearing bars 180 for reduced friction, and draws the two back ends of wall 32 together by pulling on the free end 182 of strap 42 with his or her teeth.

The user then draws and tightens strap 28 by teeth. The straps are fastened in place by pressing their Velcro (tm) 184 ends 182 and 188 down. Sufficient length of strap and stops, not shown, on the straps may be included so that the straps are always through the bar pulleys even when the ends of wall 32 are spread fully apart and so that there is sufficient room to slip the hand in the appliance from the back below the loosened straps, and the user will not need to thread the strips through the bar pulleys.

In FIGS. 9–12, like elements to those in FIGS. 1–5 have the same number designators.

Figure 9:
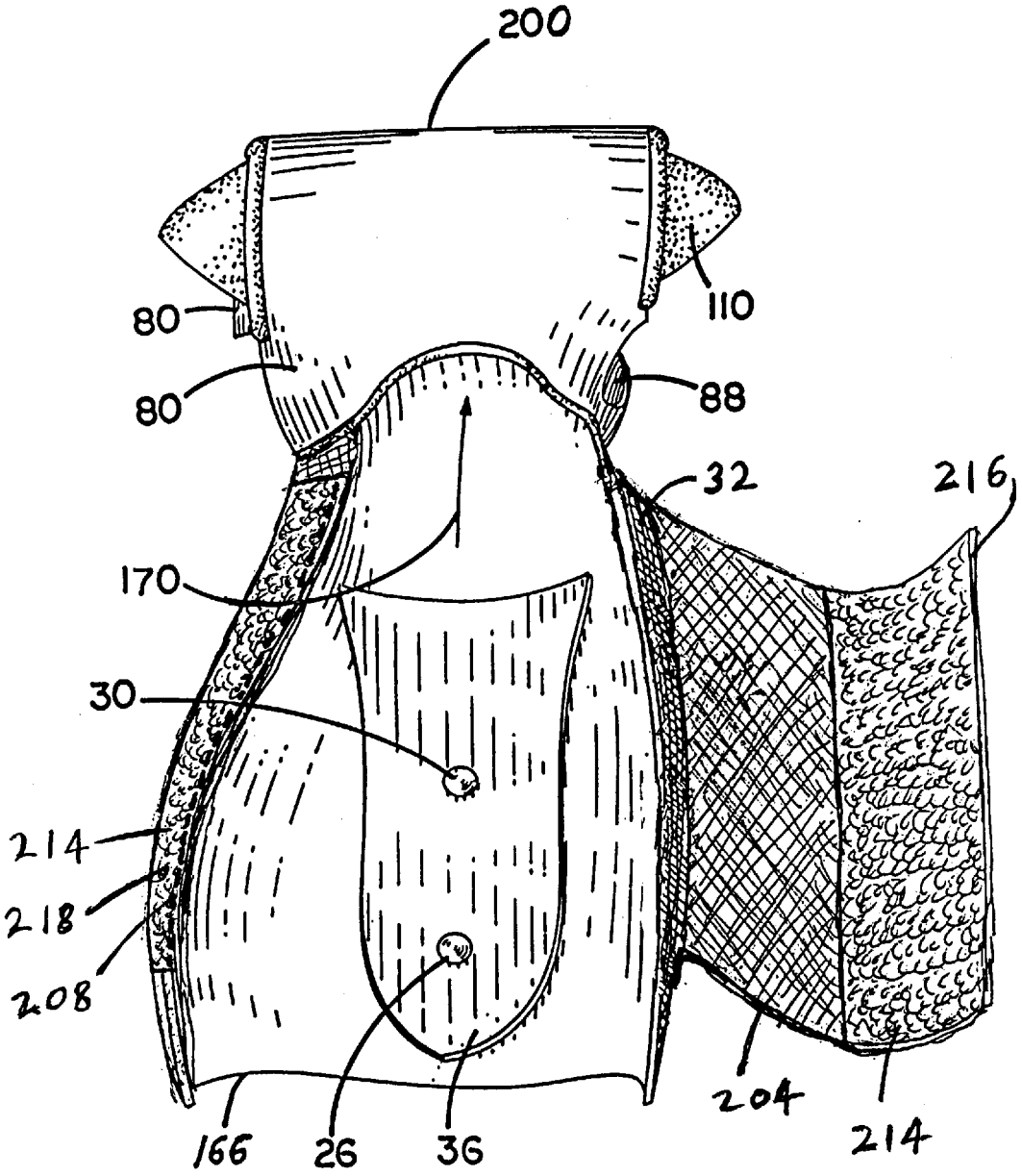
FIG. 9 is a back view of another appliance of the invention.
Figure 10:
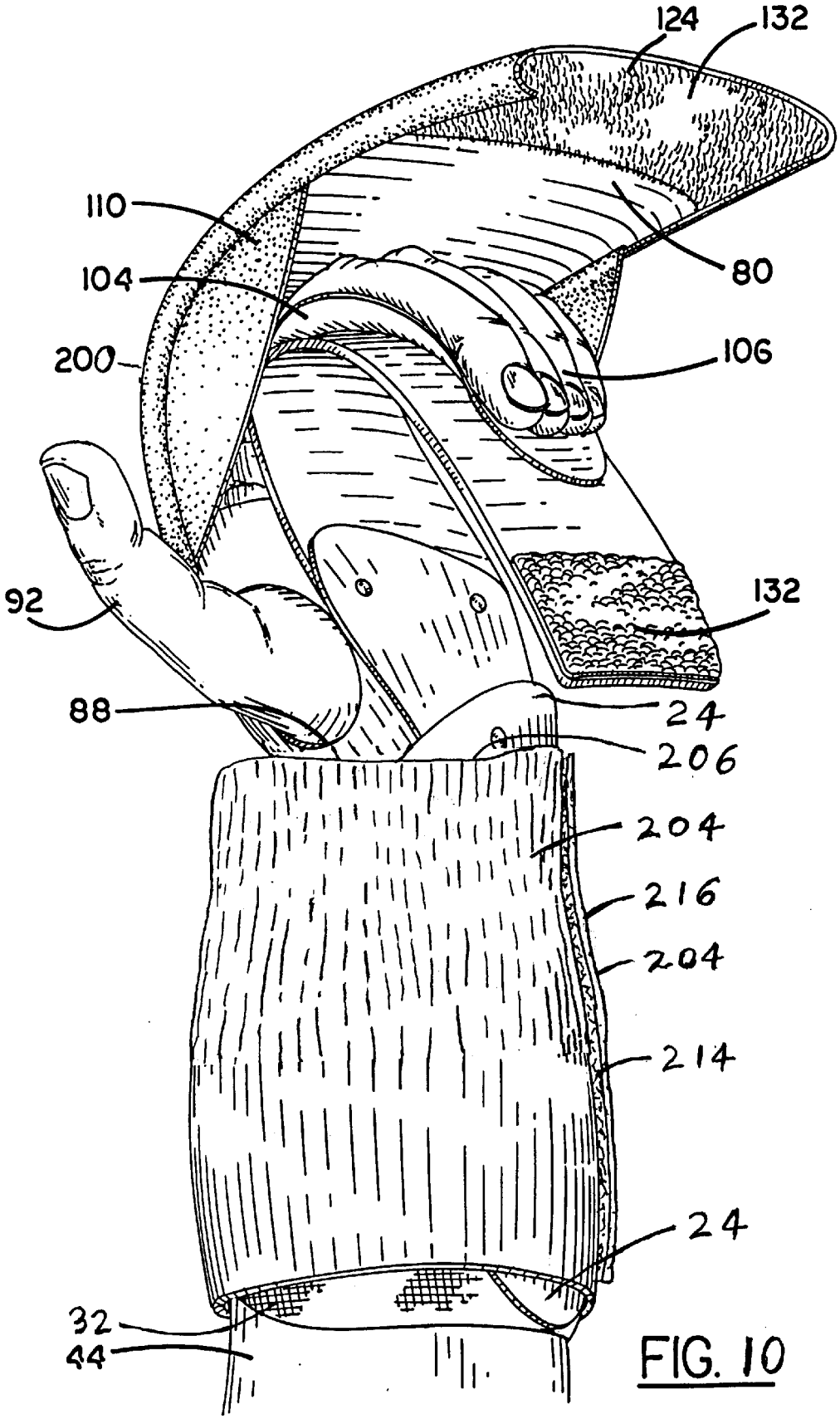
FIG. 10 is an oblique front and left side perspective view of the appliance of FIG. 9 mounted on a hand.

Referring to FIGS. 9 and 10 of appliance 200, elastic fastening strap 204 is mounted on appliance 200 close to the wrist area proximal of the hand area of the appliance. This includes an edge 206 of strap 204 extending slightly onto the hand area of the appliance although that is not required for operation of the appliance.

One end of the strap is stitched 208 to wall 32. The free end 216 of the strap is adapted to hold to outer surface 218 of the strap by Velcro(tm) 214, however a plurality of snaps, hooks or buttons may be used. Strap 204 is designed to attach plate 24 to the forearm so that it is held rigid with the forearm although there will be slight yield due to the softness of forearm tissue.

The strap passes over the front of plate 24 and is drawn across the back of the appliance before engaging the Velcro, snaps or hooks.

The appliance can be installed on the hand by placing the hand in the appliance from the open back 166 and sliding the palm and four fingers through opening 170 and thumb out through opening 88.

The forearm area of the appliance is cupped in the installer's hand so that it is snug around the user's forearm, and strap 204 is pulled by the free end from one side of the appliance across the back of the appliance and attached to the appliance on the other side of the appliance.

Flexible strip 80 is then fastened down over the fingers on plate 46.

Figure 11:
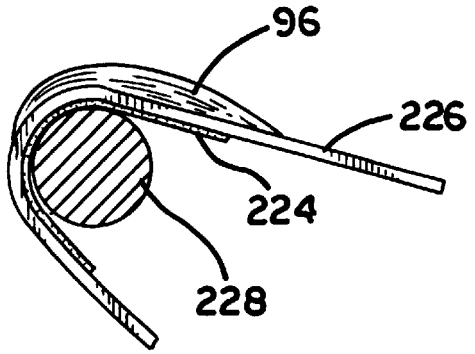
FIG. 11 is a partial side view of elements of another appliance of the invention on an exercise bar.

Referring to FIG. 11, rubbery pad 224 such as a layer of natural rubber or elastomeric rubber on U-shaped plate 226 prevents lateral sliding of the plate along exercise bar 228.

Figure 12:
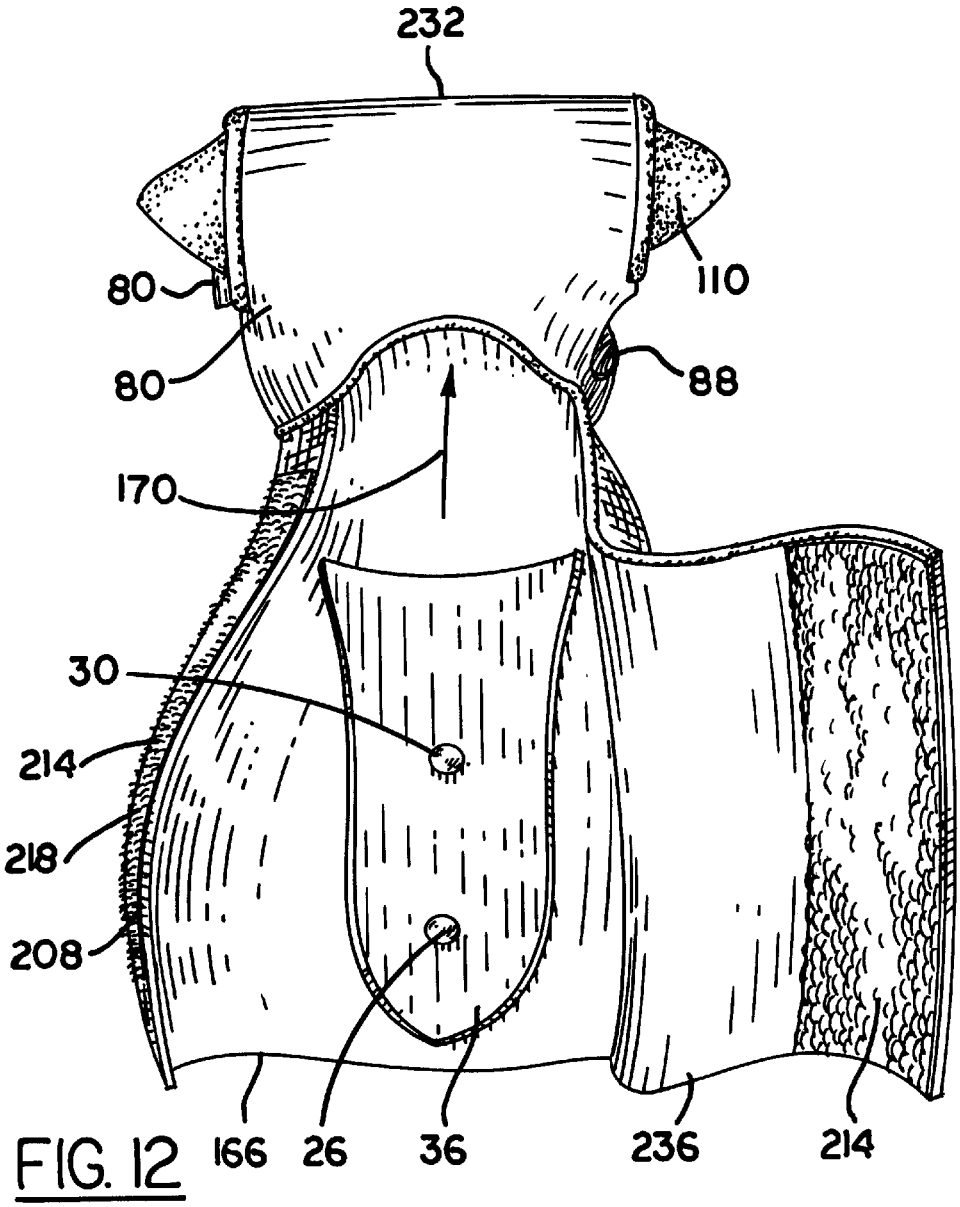
FIG. 12 is a back view of another appliance of the invention.

Referring to FIG. 12, since plate 24 of appliance 232 is well fastened to wall 32, fastening strap 236 can be made from an extending flap of wall 32 whereby the wall extends across the back of the appliance and is attached to itself by Velcro on the other side of the appliance.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A kinestherapy appliance for wearing on a hand and forearm of a user, said appliance comprising:

said appliance having a front, a back, a wrist area and a hand area, a first plate on the front of said appliance, being elongated, rigid, and having a first end and a second end, first means for fastening mounted on said appliance close to the wrist area of the appliance proximal of the hand area of the appliance, configured for attaching, said first plate to the user's forearm over the front of the user's forearm, a second plate on the front of said appliance, being elongated, U-shaped, rigid, and having a first end and a second end, said first end being on a first leg of the U-shape which curves forward from said first leg to a second leg, and said second end being on the second leg of the U-shape, said first end of said second plate being connected to said first end of said first plate on the front of said appliance so that the apex of the U-shape is distal from said first plate, and said second end of said second plate is proximal from said apex, said second leg being forward of said first leg, said second plate being positioned and configured to receive at least the second through fourth fingers of the hand wrapped over and around the apex of the U-shaped plate, a first strip, being flexible, having a first end connected to said appliance, and having a second end, second means for fastening configured for temporarily fastening said second end of said first strip to said second end of said second plate so that the at least second through fourth fingers of a hand in said appliance are held on said second plate on the front of said appliance by said first strip against the backs of the fingers, said second end of said first strip being configured to extend over the ends of fingers held on said second plate by said first strip.

2. The appliance of claim 1, further comprising:

pivot means having an axis aligned front to back of said appliance and connecting said first end of said second plate to said first end of said first plate so that the apex of the U-shape is distal from said pivot means, and is pivotal side to side about said axis of said pivot means.

3. The appliance of claim 2, further comprising:

a third plate comprising said pivot means and connecting said second plate to said first plate.

4. The appliance of claim 2, wherein:

said first plate is connected to said second plate so as to prevent rotating said first plate forward or backward of said second plate on an axis through the connection.

5. The appliance of claim 1, wherein:

said second means for fastening is positioned and configured on said second end of said first strip and said second end of said second plate wherein unfastening of said second means for fastening may be made by just pulling generally the second end of said strip away from the second end of second plate in a direction within the range of a first line generally planar with and away from said second end of said second plate, to a line generally normal to said first line and away from said appliance.

6. The appliance of claim 5, further comprising:

pivot means having an axis aligned front to back of said appliance and connecting said first end of said second plate to said first end of said first plate so that the apex of the U-shape is distal from said pivot means, and is pivotal side to side about said axis of said pivot means.

7. The appliance of claim 6, further comprising:

a pair of flexible side walls attached to said first plate and separated from one another at the back of the appliance leaving an opening through said appliance from the back of said appliance to the apex of said second plate.

8. The appliance of claim 1, further comprising:

a pair of flexible side walls attached to said first plate and separated from one another at the back of the appliance leaving an opening through said appliance from the back of said appliance to the apex of said second plate.

9. The appliance of claim 1, wherein:

said second leg of said U-shaped second plate is forward of said first plate, said apex comprises a backward facing inner wall comprising a rubbery layer having a contour sized and configured to closely and slidingly fit over a standard exercise bar.

10. A kinestherapy appliance for wearing on a hand and forearm of a user, said appliance comprising:

said appliance having a front, a back, a wrist area and a hand area, a first plate on the front of said appliance being elongated, rigid, and having a first end and a second end, first means for fastening mounted on said appliance close to the wrist area of the appliance proximal of the hand area of the appliance, configured for attaching said first plate to the user's forearm over the front of the user's forearm, a second plate on the front of said appliance being elongated, U-shaped, rigid, and having a first end and a second end, said first end being on a first leg of the U-shape which curves forward from said first leg to a second leg, and said second end being on said second leg of the U-shape, said first end of said second plate being connected to said first end of said first plate on the front of said appliance so that the apex of the U-shape is distal from said first plate, and said second end of said second plate is proximal from said apex, said second leg being forward of said first leg, said second plate being positioned and configured to receive at least the second through fourth fingers of the hand wrapped over and around the apex of the U-shaped plate, a first strip, being flexible, having a first end connected to said appliance, and having a second end, second means for fastening configured for temporarily fastening said second end of said first strip to said second end of said second plate so that the at least second through fourth fingers of a hand in said appliance are held on said second plate on the front of said appliance by said first strip against the backs of the fingers, pivot means having an axis aligned front to back of said appliance and connecting said first end of said second plate to said first end of said first plate so that the apex of the U-shape is distal from said pivot means, and is pivotal side to side about said axis of said pivot means, said second means for fastening being positioned and configured on said second end of said first strip and said second end of said second plate wherein unfastening of said second means for fastening may be made by just pulling generally the second end of said strip away from the second end of second plate in a direction within the range of a first line generally planar with and away from said second end of said second plate, to a line generally normal to said first line and away from said appliance, a soft tongue mounted on said second plate and positioned for receiving fingers wrapped over and around the apex of the U-shaped plate, and having a raised portion by which said tongue restricts lateral movement toward one side of said tongue of fingers on said tongue.

11. The appliance of claim 10, further comprising:

a third plate comprising said pivot means and connecting said second plate to said first plate.

12. The appliance of claim 11, wherein:

said second leg of said U-shaped second plate is forward of said first plate, said apex comprising a backward facing inner wall having a contour sized and configured to closely and slidingly fit over a standard exercise bar.

13. A kinestherapy appliance for wearing on a hand and forearm of a user, said appliance comprising:

said appliance having a front, and a back, a first plate on the front of said appliance, being elongated, rigid, and having a first end and a second end, first means for fastening configured for attaching said first plate to the user's forearm over the front of the user's forearm, a second plate on the front of said appliance, being elongated, U-shaped, rigid, and having a first end and a second end, said first end being on a first leg of the U-shape which curves forward from said first leg to a second leg, and said second end being on the second leg of the U-shape, said first end of said second plate being connected to said first end of said first plate on the front of said appliance so that the apex of the U-shape is distal from said first plate, and said second end of said second plate is proximal from said apex, said second leg being forward of said first leg, said second plate being positioned and configured to receive at least the second through fourth fingers of the hand wrapped over and around the apex of the U-shaped plate, a first strip, being flexible, having a first end connected to said appliance, and having a second end, second means for fastening configured for temporarily fastening said second end of said first strip to said second end of said second plate so that the at least second through fourth fingers of a hand in said appliance are held on said second plate on the front of said appliance by said first strip against the backs of the fingers, said second end of said first strip being configured to extend over the ends of fingers held on said second plate by said first strip.

* * * * *